US005262747A

United States Patent [19]

Eijndhoven et al.

[11] Patent Number: 5,262,747

[45] Date of Patent: Nov. 16, 1993

[54] WINDING SUPPORT AND METHOD OF FORMING AN ASSEMBLY COMPRISING AN ELECTRIC COIL AND AN ELECTRONIC COMPONENT BY MEANS OF SUCH A SUPPORT

[75] Inventors: Gerardus P. J. J. Eijndhoven; Franciscus J. Eijsermans; Petrus C. J. J. Van Loon, all of Tilburg, Netherlands

[73] Assignee: U.S. Philips Corporation, New York, N.Y.

[21] Appl. No.: 15,711

[22] Filed: Feb. 9, 1993

Related U.S. Application Data

[63] Continuation of Ser. No. 545,317, Jun. 27, 1990, Pat. No. 5,210,515.

[30] Foreign Application Priority Data

Jun. 30, 1989 [NL] Netherlands ..... 8901663

[51] Int. Cl.[5] ..... H01F 15/10; H01F 27/30; H01F 7/06

[52] U.S. Cl. ..... 336/192; 336/65; 336/208; 29/605; 29/606

[58] Field of Search ..... 336/65, 105, 192, 208, 336/195; 323/355; 29/605, 606

[56] References Cited

U.S. PATENT DOCUMENTS

| | | | |
|---|---|---|---|
| 3,149,297 | 9/1964 | Rechel | 336/209 |
| 3,196,523 | 7/1965 | Bell | 29/605 |
| 3,597,715 | 8/1971 | Davis | 336/96 |
| 3,735,307 | 5/1973 | De Groot | 336/192 |

*Primary Examiner*—Leo P. Picard
*Assistant Examiner*—Bot Ledynh
*Attorney, Agent, or Firm*—Edward Blocker

[57] ABSTRACT

The winding support comprises a first cylindrical portion (1) which comprises a winding space for a coil winding which is situated between a first wire fastener unit (7) and a wire guide (5), and a second portion (3) which is situated in the prolongation thereof and which is shaped as a semi-cylinder with a flat supporting face (17) for mounting an electronic component (23) which comprises contact pads (25, 27). The component (23) is mounted in a recess (19) at the area of the lacking cylinder half, which recess is axially bounded by the wire guide (5) on the one side and by a second wire fastener unit (21) on the other side. Lead-out wires (31, 41) of the coil winding are guided by way of the wire guide (5), across the contact pads (25, 27) to the second wire fastener unit (21) whereto they are fastened. Subsequently, soldered or welded joints (43, 45) are formed between the lead-out wires (31, 41) and the contact pads (25, 27) by way of a thermal treatment.

10 Claims, 1 Drawing Sheet

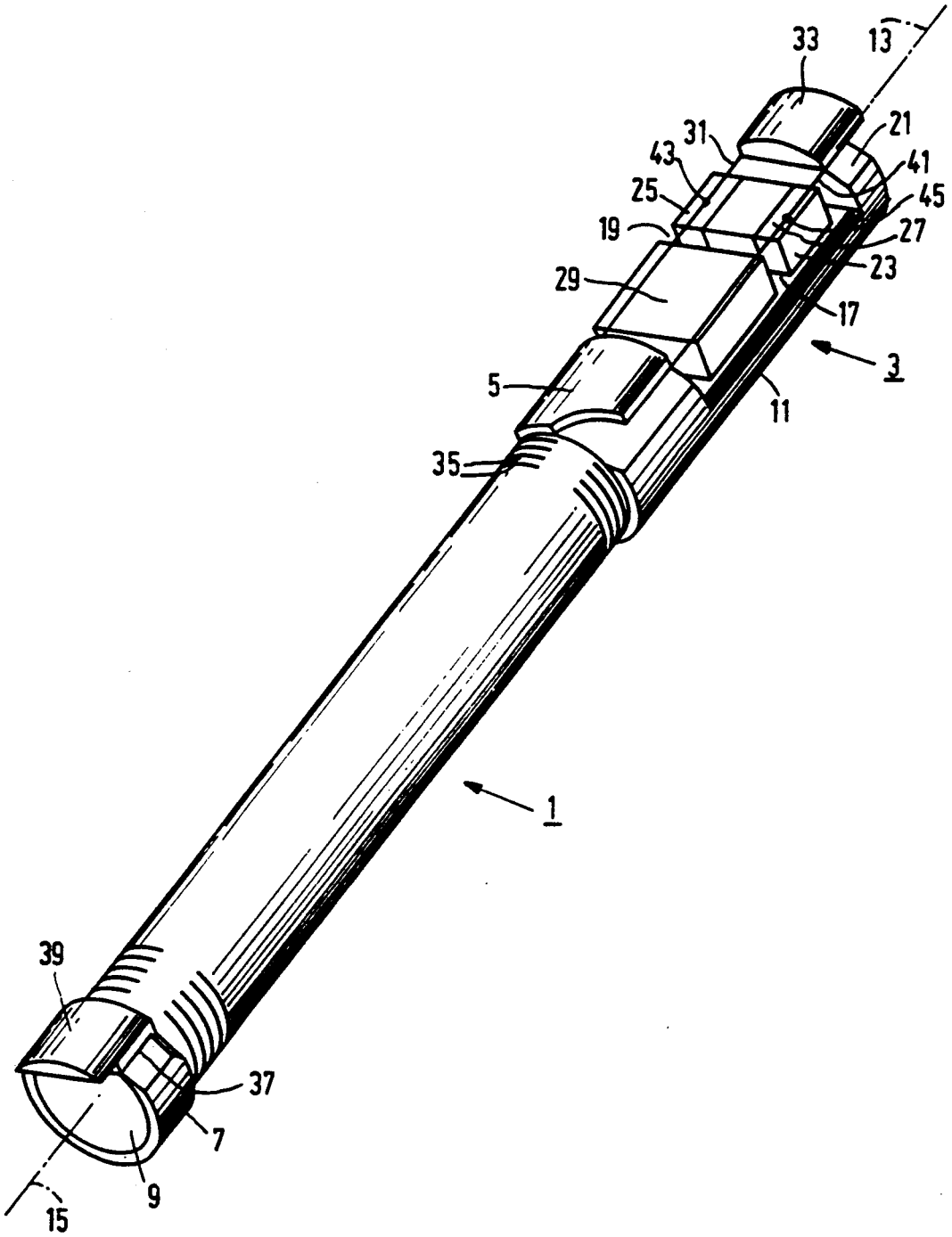
33
13
31
21
43
41
25
45
19
27
23
29
17
3
5
11
35
1
39
37
7
9
15

WINDING SUPPORT AND METHOD OF FORMING AN ASSEMBLY COMPRISING AN ELECTRIC COIL AND AN ELECTRONIC COMPONENT BY MEANS OF SUCH A SUPPORT

This is a continuation of application Ser. No. 07/545,317, filed Jun. 27, 1990, now U.S. Pat. No. 5,210,515.

BACKGROUND OF THE INVENTION

1. Field of the Invention

The invention relates to a winding support, comprising a first, substantially cylindrical portion which comprises a winding space for a coil winding and a second portion which is situated in the prolongation of the first portion and which comprises a recess for accommodating an electronic component comprising contact pads.

The invention also relates to a method of forming an assembly comprising at least an electric coil and an electronic component comprising contact pads by means of such a winding support.

2. Description of Related Art

A winding support and a method of the kind set forth done are known from U.S. Pat. No. 4,517,509. In the known device the lead-out wires of the coil as well as the contact pads of the component are soldered to metallized contact feet. The connection between each contact pad and the associated lead-out wire of the coil, therefore, comprises two soldered connections: from the contact pad to the contact foot; and from the contact foot to the coil lead-out wire. Consequently, in some cases the reliability of this connection is less than desirable. Moreover, when the component is mounted in the appropriate recess, the coil lead-out wires are liable to be damaged.

SUMMARY OF THE INVENTION

It is an object of the invention to provide a winding support and a method of the kind set forth which enable direct connection to be simply realized between the contact pads of the component accommodated in the recess, and the coil lead-out wires. To achieve this, the winding support in accordance with the invention is characterized in that the first portion of the winding support is provided with a first wire fastening means at its free end, the second portion being shaped mainly as a semi-cylinder which is bounded by a curved surface of cylinder whose axis coincides substantially with the axis of the first portion, and by a flat supporting face for mounting the electronic component, the recess being situated at the area of the lacking cylinder half and being bounded in the axial direction on the one side by a wire guide which is situated between the first and the second portion and on the other side by a second wire fastening means which is situated at the free end of the second portion. The method in accordance with the invention is characterized in that a) the electronic component is mounted on the supporting face so that two of the contact pads are situated in a plane parallel to the supporting face;

b) an electrically conductive wire comprising an insulating jacket is fastened to the second wire fastening means, is guided as the first coil lead-out wire across a first contact pad of the electronic component to the winding space, in which it is wound around the first portion of the winding support in order to form the coil, a portion of the wire which adjoins the turn of the coil which is situated nearest to the free end of the first portion being fastened to the first wire fastening means, after which the wire is guided back as the second coil lead-out wire across a second contact pad of the electronic component so as to be fastened to the second fastening means;

c) the first and the second lead-out wire are electrically and mechanically connected to the first and the second contact pad, respectively, by way of a thermal treatment.

The connection between the coil lead-out wires and the contact pads can be realized, for example by soldering or welding, the insulating jacket being burnt under the influence of the heat at that area. After this connection has been made, the second wire fastening means no longer plays a part in keeping the coil lead-out wires in position. Therefore, if desirable, it can subsequently be removed by a suitable chopping or cutting operation. These aspects and other aspects of the invention will be described in detail with reference to the drawing.

BRIEF DESCRIPTION OF THE DRAWING

The drawing is a perspective view of an embodiment of a winding support in accordance with the invention, together with a coil and electronic components mounted thereon.

DETAILED DESCRIPTION OF THE PREFERRED EMBODIMENT

The winding support shown comprises a first portion 1 and a second portion 3 which is situated in the prolongation thereof. The first portion 1 has a substantially cylindrical shape and its cylindrical surface includes a winding space for a coil winding, which winding space is bounded at one end by a wire guide 5 which forms the transition to the second portion 3. At the other end the winding space is bounded by a first wire fastening means 7 which is situated at the free end of the first portion. The first portion 1 may consist of, for example a ferrite rod 9 on which the first wire fastening means 7 and the wire guide 5 are provided. The first wire fastening means 7 and the wire guide 5 are made of a suitable plastics, for example by injection molding. The wire guide 5 is integral with the second portion 3 which is made of the same material and which is shaped as a semi-cylinder which is bounded by a surface of cylinder 11 whose axis 13 is substantially coincident with the axis 15 of the first portion 1. The semi-cylinder is further bounded by a flat supporting face 17. At the area of the lacking cylinder half there is provided a recess 19 which is bounded in the axial direction by the wire guide 5 on the one side and on the other side by a second wire fastening means 21 which is situated at the free end of the second portion and which is formed so as to be integral with this portion and the wire guide, for example by injection molding.

On the supporting face 17 there is mounted an electronic component 23 which comprises first and second contact pads 25 and 27 which are situated in a plane parallel to the supporting face 17 and which are freely accessible. The connection between the component 23 and the supporting face 17 may be formed, for example by a glued or soldered joint . The supporting face 17 may be provided with conductor tracks to which third and fourth contact pads of the component 23 are soldered (not shown). The component 23 may be, for example a capacitor or a resistor which is constructed as a surface-mounted device. On the supporting face 17 there may also be mounted further electronic components, for example an integrated circuit 29 whose lower side (and possibly also its upper side) includes contact pads which are also soldered to the conductor tracks of the supporting face 17. If desirable, the various parts can also be interconnected in other known manners, for example by way of bonding.

A first end 31 of an electrically conductive wire provided with an insulation jacket is secured to the second wire fastening means 21 by wrapping it a few times around a protrusion 33 which forms part of this wire fastening means. Subsequently, the wire is guided across the first contact face 25 of the component 23 to the winding space on the first portion 1 of the winding support and is wound in a number of turns 35 around said first portion in order to form an electric coil. The portion 37 of the wire which adjoins the turn situated nearest to the free end of the first portion 1 is fastened to the first wire fastening means 7 by wrapping it a few times around a protrusion 39 which forms part of this wire fastening means. The wire is subsequently guided back to the wire guide 5 and, by means of this guide, as a second coil lead-out wire 41 back across the second contact pad 27 of the component 23 to the second wire fastening means 21 to which it is fastened again by wrapping it a few times around the protrusion 33. The first end 31 of the wire constitutes the first lead-out wire of the coil. The wire guide 5 is constructed so that the two coil lead-out wires 31 and 41 extend in parallel across the contact pads 25 and 27, respectively. The described manipulations of the wire can be readily executed on a known coil winding machine in a fully automatic manner. Evidently, the wire can alternatively be guided from the first contact pad 25 directly to the first wire fastening means 7 so as to be wound from this means in the direction of the wire guide 5.

After the wire has been fastened to the second wire fastening means 21 for the second time, the first and the second leadout wires 31 and 41 are electrically and mechanically connected to the first and the second contact pads 25 and 27, respectively, by means of a thermal treatment (for example, soldering or welding). The insulating jacket of the wire is then locally destroyed. The joints are denoted by the reference numerals 43 and 45.

Finally, if desirable the second wire fastening means 21 can be removed by a suitable chopping or cutting operation. The leadout wires 31 and 41 are maintained in position by the connections 43 and 45 to the contact pads 25 and 27. The assembly thus formed can be encapsulated, if desired, in an insulating plastics or be enveloped by glass.

We claim:

1. An assembly, comprising:

a winding support including a first, substantially cylindrical portion and a substantially semi-cylindrical second portion extending therefrom, said first portion having an axis, a winding space for a coil winding and first wiring fastening means, said second portion formed by severing second wiring fastening means therefrom and including a curved cylindrical surface having an axis which coincides substantially with the axis of said first portion and a recess having a flat supporting face for mounting an electronic component which includes a first contact pad and a second contact pad, said recess bounded by a wire guide positioned between the first portion and the second portion and, prior to severing, by said second wire fastening means; and said coil winding being wound around said first portion in said winding space and connected to said first wire fastening means and having a first lead-out wire positioned across said first contact pad and a second lead-out wire positioned across said second contact pad and, prior to severing, connected to said second wire fastening means.

2. The assembly of claim 1, wherein said first portion and said second portion each have a distal end, said first wire fastening means and said second wire fastening means being positioned near the distal ends of said first portion and said second portion, respectively.

3. The assembly of claim 1, wherein said first lead-out wire and said second lead out are connected to said first contact pad and said second contact pad, respectively.

4. A method of forming the assembly of claim 3, comprising connecting said first lead-out wire and said second lead out wire to said first contact pad and second contact pad, respectively, through thermal treatment.

5. A method of forming the assembly of claim 3, comprising severing said second wiring fastening means following connection of said first lead-out wire and said second lead-out wire to said first contact pad and said second contact pad, respectively.

6. The method of claim 4, further comprising severing said second wiring fastening means following connection of said first lead-out wire and said second lead-out wire to said first contact pad and said second contact pad, respectively.

7. The assembly of claim 2, wherein said first lead-out wire and said second lead out are connected to said first contact pad and said second contact pad, respectively.

8. A method of forming the assembly of claim 7, comprising connecting said first lead-out wire and said second lead out wire to said first contact pad and second contact pad, respectively, through thermal treatment.

9. A method of forming the assembly of claim 7, comprising severing said second wiring fastening means following connection of said first lead-out wire and said second lead-out wire to said first contact pad and said second contact pad, respectively.

10. The method of claim 8, further comprising connecting said first lead-out wire and said second lead out wire to said first contact pad and second contact pad, respectively, through thermal treatment.

* * * * *